US009482200B2

(12) United States Patent
Ikemori et al.

(10) Patent No.: US 9,482,200 B2
(45) Date of Patent: Nov. 1, 2016

(54) STARTER

(75) Inventors: Tomohiko Ikemori, Kiryu (JP); Hiroshi Ooka, Kiryu (JP); Masaaki Oya, Kiryu (JP); Masataka Odagiri, Kiryu (JP); Shigehiro Kanbe, Kiryu (JP); Hiroki Yamada, Kiryu (JP); Seiji Shimada, Utsunomiya (JP); Yusuke Fukada, Shioya-gun (JP); Takayuki Yamagata, Utsunomiya (JP); Masahiro Nakamura, Sakura (JP)

(73) Assignees: Mitsuba Corporation, Kiryu-shi (JP); Honda Motor Co., Ltd., Tokyo (JP)

( * ) Notice: Subject to any disclaimer, the term of this patent is extended or adjusted under 35 U.S.C. 154(b) by 220 days.

(21) Appl. No.: 14/388,055

(22) PCT Filed: Mar. 30, 2012

(86) PCT No.: PCT/JP2012/058706

§ 371 (c)(1),
(2), (4) Date: Oct. 9, 2014

(87) PCT Pub. No.: WO2013/145299

PCT Pub. Date: Oct. 3, 2013

(65) Prior Publication Data

US 2015/0047594 A1 Feb. 19, 2015

(51) Int. Cl.
*F02N 15/02* (2006.01)
*F02N 11/00* (2006.01)
(Continued)

(52) U.S. Cl.
CPC ..... *F02N 15/062* (2013.01); *F02N 11/00* (2013.01); *F02N 11/0851* (2013.01); *F02N 15/00* (2013.01); *F02N 15/02* (2013.01)

(58) Field of Classification Search
CPC ..... F02N 15/023; F02N 11/00; F02N 15/02; F02N 15/062; F02N 15/045; F02N 15/06; F02N 15/021; F02N 19/001
USPC ..... 123/179.25; 74/7 C, 7 E; 310/91, 71
See application file for complete search history.

(56) References Cited

U.S. PATENT DOCUMENTS

2010/0257975 A1 10/2010 Niimi et al.

FOREIGN PATENT DOCUMENTS

CN 1573085 A 2/2005
CN 1759241 A 4/2006
(Continued)

OTHER PUBLICATIONS

Japanese Patent Office, International Search Report in PCT Application No. PCT/JP2012/058706, mailed Jun. 19, 2012.
(Continued)

*Primary Examiner* — Lindsay Low
*Assistant Examiner* — Syed O Hasan
(74) *Attorney, Agent, or Firm* — Wood Herron & Evans LLP

(57) ABSTRACT

Formed in a pinion (74) are pinion-side helical external teeth (74A) that mesh with a ring gear 823), and pinion-side helical internal teeth (74*a*) that mesh with a pinion inner (71). Formed in the pinion inner (71) are pinion inner-side helical external teeth (73) that mesh with the pinion-side helical internal teeth (74*a*). The configuration is formed so that when the rotational speed of the pinion (74) is slower than that of the ring gear (23), a thrust load is generated in a direction toward the ring gear (23), and when the rotational speed of the pinion (74) is faster than that of the ring gear (23), a thrust load is generated in a direction away from the ring gear (23).

4 Claims, 11 Drawing Sheets

(51) Int. Cl.

| | |
|---|---|
| ***F02N 15/06*** | (2006.01) |
| ***F02N 15/00*** | (2006.01) |
| ***F02N 11/08*** | (2006.01) |

(56) References Cited

FOREIGN PATENT DOCUMENTS

| | | | |
|---|---|---|---|
| CN | 2015-54588 | U | 8/2010 |
| JP | 2000-274337 | A | 10/2000 |
| JP | 2002-130097 | A | 5/2002 |
| JP | 2002-257016 | A | 9/2002 |
| JP | 2002-285942 | A | 10/2002 |
| JP | 2007071164 | A | 3/2007 |
| JP | 2012-026337 | A | 2/2012 |

OTHER PUBLICATIONS

Japanese Patent Office, Notice of Reasons for Rejection issued in corresponding Japanese Patent Application No. 2014-507259 and English-language translation mailed Oct. 6, 2015.

The State Intellectual Property Office of the People's Republic of China, Search Report issued in corresponding Chinese Patent Application No. 2012800720073 and English-language translation dated Dec. 3, 2015.

STARTER

TECHNICAL FIELD

The present invention relates to a starter which is mounted, for example, on an automobile.

BACKGROUND ART

In related arts, as a starter which is used to start an engine of an automobile, a configuration which includes a motor configured to generate a rotating force, an output shaft configured to rotate by receiving the rotating force, a pinion mechanism provided on the output shaft slidably in an axial direction, the pinion mechanism including a pinion capable of meshing with a ring gear of the engine, and an electromagnetic equipment which biases a pressing force on the pinion mechanism toward the ring gear, has been known.

The electromagnetic equipment includes an exciting coil which forms magnetic path by being excited, and a plunger configured to move by being suctioned by the exciting coil. The pinion mechanism includes a pinion inner capable of sliding along the output shaft by receiving the pressing force from the electromagnetic equipment. The pinion is fitted with the pinion inner by a helical spline fitting, and the pinion is movable provided in the axial direction with respect to the pinion inner (e.g. see patent literature 1).

Under the configuration, when the electromagnetic equipment is energized, the plunger moves and the pressing force is biased on the pinion mechanism. Then, the pinion is pushed out toward the ring gear while rotating around the axis along the helical gear provided on the drive shaft.

At this time, the pressing force and a rotating force is acting on the pinion. For this reason, although a meshing phase between the ring gear and the pinion is misaligned and end faces of the ring gear and the pinion contacts, the pinion is capable of being meshed with the ring gear smoothly afterward.

When the pinion meshes with the ring gear and is linked, the rotation force of the motor is transferred to the ring gear via the output shaft and the pinion, and then the engine starts by the ring gear to rotate.

As the engine starts, and when a rotating speed of the ring gear becomes higher than that of the pinion, a one way clutch function of a clutch mechanism provided on the starter functions to run idle the pinion, and it is configured that the rotation of the ring gear is not transferred to the motor of the starter.

Furthermore, in recent years, in order to improve fuel consumption of an automobile and/or to reduce exhaust gas, an automobile is provided in which an idling stop function is equipped, wherein the idling stop function causes an engine in an idling state to temporary stop upon when the automobile stops, for example, to wait for a traffic light, and the idling stop function restart the engine when the automobile starts moving again. Since the starter described in the patent literature 1 is capable of meshing the pinion with the ring gear smoothly, the starter can be adopted to automobiles which are equipped with the idling stop function described above.

CITATION LIST

Patent Literature

[PTL 1]
Japanese unexamined patent application, first publication No. 2012-26337.

SUMMARY OF INVENTION

Technical Problem

However, in the related art described above, although it is advantageous in that the ring gear and the pinion can be smoothly linked, problems remain in the following points.

For example, when a driver activates the starter by a miss-operation of a key while the engine is rotating (e.g. while the ring gear is rotating), the pinion may be pushed out toward the ring gear in a state that a rotating speed of the pinion is lower than that of the ring gear.

And, for another example, in the automobile which equip the idling stop function, in a case that the engine is restarted immediately after a fuel injection of the engine is stopped, there may be a case that the ring gear rotates by an inertial rotation. Accordingly, upon restarting of the engine, the pinion may be pushed out toward the ring gear in a state that the rotating speed of the pinion is lower than that of the ring gear, in the same manner as described above.

At this time, if meshing phase of the tooth of the pinion gear and the ring gear is misaligned, the gears do not mesh each other, and although the meshing phase aligned and the pinion gear meshes with the ring gear, it is configured that the one-way clutch equipped in the starter functions not to transfer the rotation of the ring gear to the motor.

However, if a state in that each teeth is meshing continues, since a load generated by the rotating force of the ring gear is continuously transferred to the clutch mechanism of the starter, there may be a possibility that life-spans of parts configuring the starter may decrease.

The present invention provides a starter in which a life span of parts can be prolonged while maintaining a preferable linkage between a ring gear and a pinion.

Solution to Problem

According to a first aspect of the present invention, a starter includes an output shaft configured to rotate by receiving a rotating force of a motor, a pinion mechanism slidably provided on the output shaft, the pinion mechanism configured to be linkable with a ring gear of the engine and configured to transfer the rotation of the output shaft to the ring gear, and an electromagnetic equipment configured to supply and cutoff power to the motor, the electromagnetic equipment configured to bias a pressing force on the pinion mechanism toward the ring gear. The pinion mechanism includes a pinion inner provided on an outside of the output shaft and being slidable along the output shaft, a pinion provided concentrically with the pinion inner outward in a radial direction and capable of meshing with the ring gear, and a pinion spring disposed between the pinion and the pinion inner to bias the pinion toward the ring gear. The pinion is formed with a pinion-side helical external teeth which has a twisting angle and is capable of meshing with the ring gear and a pinion-side helical internal teeth which has a twisting angle and is capable of meshing with the pinion inner. On the other hand, the pinion inner is formed with a pinion inner-side helical external teeth which has a twisting angle and is capable of meshing with the pinion side helical internal teeth. The pinion-side helical external teeth is configured so that, upon the ring gear meshes with the pinion, a thrust load is generated on the pinion in a direction away from the ring gear when the rotating speed of the pinion is lower than that of the ring gear, and upon the ring gear meshes with the pinion, the thrust load in a direction approaching to the ring gear is generated on the pinion when the rotating speed of the pinion is higher than that of the ring gear. The pinion-side helical internal teeth and the pinion inner-side helical external teeth are configured such that, upon the ring gear meshes with the pinion, a thrust load in a direction approaching to the ring gear is generated on the pinion when the rotating speed of the pinion is lower than that of the ring gear, and upon the ring gear meshes with the pinion, the thrust load in a direction away from the ring gear is generated on the pinion when the rotating speed of the pinion is higher than that of the ring gear.

By configuring as described above, in a case that the rotating speed of the pinion is lower than that or the ring gear, when the ring gear meshes with the pinion and the rotating force is transferred from the ring gear to the pinion, it is possible to easily slide the pinion in a direction away from the ring gear. That is, as the pinion is lowered in an axial direction along a helical angle of the pinion inner-side helical external teeth and the pinion-side helical internal teeth, impact force acting on the pinion upon contact of end faces can be absorbed, and a wear of parts upon meshing between the pinion and the ring gear can be suppressed. According to this, transfer of a load generated by the rotating force of the ring gear to the starter can be suppressed, and the life-span of part can be prolonged.

Furthermore, the rotating force is applied to the pinion sliding moving in a direction away from the ring gear by the rotation of the ring gear, the rotating speed of the pinion is accelerated at each time this state is repeated, the rotating speed of the pinion will reach to that of the ring gear, and then the rotation of the pinion and the rotation of the ring gear synchronizes.

Then, once the ring gear starts to mesh with the pinion when the rotating speed of the pinion becomes the same rotating speed of the ring gear (synchronized state) or becomes higher than the rotating speed of the ring gear, a thrust load is generated on the pinion in a direction approaching to the ring gear, and then the pinion can be smoothly meshed with the ring gear.

Further, since the pinion spring is provided between the pinion and the pinion inner, the pinion is capable of being pressed toward the ring gear by the biasing force of the pinion spring while suppressing an impact force generated upon a meshing between the pinion and the ring gear and while synchronizing the rotating speed of the pinion with the rotating speed of the ring gear. Accordingly, it becomes possible to promptly mesh the pinion with the ring gear while suppressing wear of parts upon meshing between the pinion and the ring gear.

Accordingly, it becomes possible to prolong the life span of the parts while maintaining a preferable linkage between a ring gear and a pinion.

According to a starter of a second aspect of the present invention, the twisting direction of the pinion inner-side helical external teeth is set in the same direction with the twisting direction of the pinion-side helical external teeth which meshes with the ring gear.

By configuring in this way, a direction of the thrust load generated on a connecting part between the pinion and the ring gear can be reversed against a direction of the thrust load generated on a connecting part between the pinion and the pinion inner. By this configuration, when the rotating speed of the pinion is lower than that of the ring gear, the pinion can be moved in a direction away from the ring gear as end faces of the pinion and the ring gear contact, and when the rotating speed of the pinion is higher than that of the ring gear, the pinion can be moved in a direction approaching to the ring gear. Accordingly, the life span of the parts can be further prolonged while maintaining further preferable linkage between a ring gear and a pinion.

According to a third aspect of the present invention, in the starter, twisting directions of the pinion-side helical external teeth, pinion-side helical internal teeth and the pinion inner-side helical external teeth are defined based on a twisting direction of a teeth part of the ring gear.

By configuring in this way, even for a configuration in which another gear, such as an idle gear, is interposed between the pinion and the ring gear, twisting directions of the pinion-side helical external teeth, pinion-side helical internal teeth and the pinion inner-side helical external teeth of the pinion can be easily defined. Accordingly, the aspect of the present invention can be adopted to a configuration in which a pinion and a ring gear are linked without directly meshing.

According to a fourth aspect of the present invention, in the starter, the electromagnetic equipment includes an exciting coil provided in a cylindrical shape, and a gear plunger capable of sliding moving along the output shaft based on a power supply to the exciting coil and configured to bias a pressing force on the pinion mechanism. The electromagnetic equipment is provided coaxially with the output shaft.

By configuring in this way, the aspect of the present invention can be preferably adopted to a so-called uniaxial starter in which electromagnetic equipment and an output shaft are coaxially provided. Accordingly, in the uniaxial starter, it becomes possible to prolong parts while maintaining a preferable linkage between a ring gear and a pinion.

Advantageous Effects of Invention

According to the above, in a case that the rotating speed of the pinion is lower than that of the ring gear, the pinion can be easily slidingly moved in a direction apart for the ring gear when the ring gear meshes with the pinion and the rotating force is transferred from the ring gear to the pinion. That is, as the pinion goes down in the axial direction along helical angles of the pinion inner-side helical external gear and the pinion inner-side helical internal teeth, an impact force applied on the pinion upon contacting of end faces can be absorbed, and wear of parts upon meshing between the pinion and the ring gear can be suppressed. According to this, since transferring of load generated by the rotating force of the ring gear to the starter, the life-span of parts can be prolonged.

Further, the rotating force is applied on the pinion sliding moving in a direction away from the ring gear by the rotation of the ring gear, the rotating speed of the pinion is accelerated at each time this state is repeated, the rotating speed of the pinion reaches to that of the ring gear, and then the rotation of the pinion and the rotation of the ring gear synchronizes.

Then, once the ring gear starts to mesh with the pinion when the rotating speed of the pinion becomes the same rotating speed of the ring gear (synchronized state) or becomes higher than the rotating speed of the ring gear, a thrust load is generated on the pinion in a direction approaching to the ring gear, and then the pinion can be smoothly meshed with the ring gear.

Further, since the pinion spring is provided between the pinion and the pinion inner, the pinion is capable of being pressed toward the ring gear by the biasing force of the pinion spring while suppressing an impact force generated upon a meshing between the pinion and the ring gear and while synchronizing the rotating speed of the pinion with the rotating speed of the ring gear. Accordingly, it becomes possible to promptly mesh the pinion with the ring gear while suppressing wear of parts upon meshing between the pinion and the ring gear.

Accordingly, it becomes possible to prolong the life span of the parts while maintaining a preferable linkage between a ring gear and a pinion.

DESCRIPTION OF EMBODIMENTS (Starter)

An embodiment of the present invention will be described with reference to the attached drawings.

Figure 1:
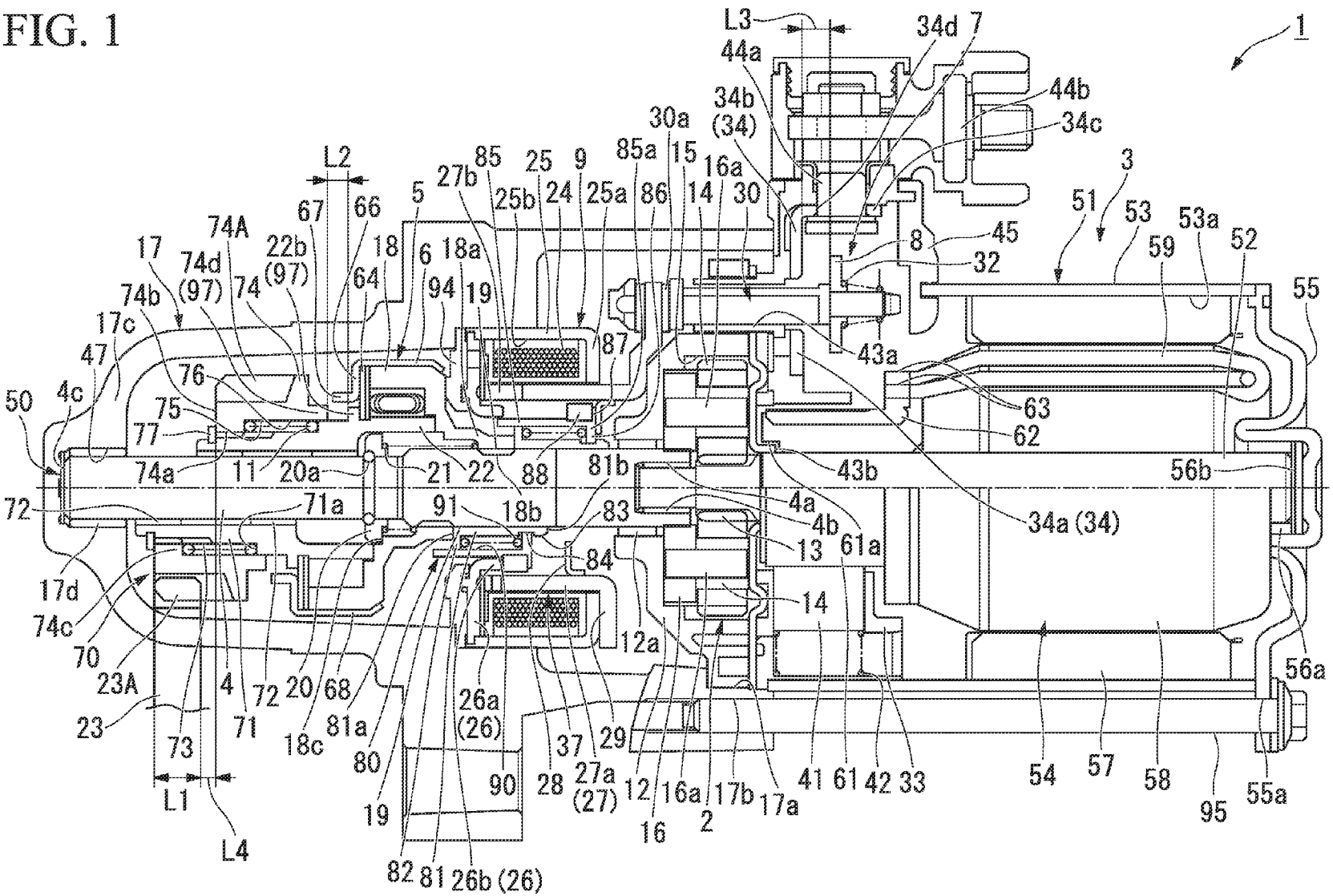
FIG. 1 is a cross sectional view of a starter of an embodiment of the present invention.

FIG. 1 shows a cross sectional view of a starter 1. In FIG. 1, a resting state of the starter 1 is described above a center line, and a energized state (a state in which a pinion 74 meshes with a ring gear 23) is described below the center line.

As described in FIG. 1, the starter 1 is a member which generates a rotating force required to start an engine of an automobile, which are not described in the drawing. The starter 1 includes a motor 3, an output shaft 4 connected to one side of the motor 3 (left-hand side of the FIG. 1), a clutch mechanism 5 and pinion mechanism 70 both of which are slidably provided on the output shaft 4, a switch unit 7 which open and/or close a power supply path to the motor 3, and an electromagnetic equipment 9 which causes a movable contact plate 8 of the switch unit 7 and the pinion mechanism 70 to move in an axial direction.

(Motor)

The motor 3 is configured of a DC brush motor 51 and a planetary gear train 2 connected to a rotating shaft 52 of the DC brush motor 51 and configured to transfer a rotating force of the rotating shaft 52 to the output shaft 4.

The DC brush motor 51 includes a motor yoke 53 which has a substantially cylindrical shape, and an armature 54 which is provided radially inward of the motor yoke 53 and is rotatable with respect to the motor yoke 53. Inner circumferential of the motor yoke 53 is provided with a plurality of pieces of permanent magnets 57 (six pieces in this embodiment) in a manner that magnetic poles thereof are alternatively disposed in a circumferential direction.

An end palate 55 which closes an opening 53*a* of the motor yoke 53 is provided in an edge of the motor yoke on the other side in the axial direction (right-hand side of FIG. 1). In a substantially center in the radial direction of an end plate 55, a sliding bearing 56*a* which rotatably supports the other end side of the rotating shaft 52 and a thrust bearing 56*b* are provided.

An armature 54 is configured of the rotating shaft 52, an armature core 58 which is outwardly fitted to the rotating shaft 52 at a position corresponds to the permanent magnet 57, and a commutator 61 outwardly fitted to the rotating shaft 52 at a position closer to the planetary gear train 2 rather than the armature core 58 (left-hand side of FIG. 1).

The armature core 58 includes a plurality of teeth (which is not described in the drawings) radially formed, and a plurality of slots (which are not described in the drawings) formed between each of the teeth adjacent in a circumferential direction. In between each slot between the predetermined intervals in the circumferential direction, a coil 59 is wound by, for example, a wave winding. A terminal of the coil 59 is pulled out toward the commutator 61.

The commutator 61 is provided with a plurality of segments 62 in the circumferential direction having predetermined intervals in between so as to be electrically insulated to each other. Each end of the segment 62 closer to the armature core 58 is provided with a riser 63 formed by bending so as to be folded back. The terminal of the coil 59 wound around the armature core 58 is connected to the riser 63.

A brush holder 33 is provided outwardly in the radial direction of the commutator 61. A fixed contact plate 34 and a cover 45, which protect around the switch shaft 30, are equipped on the brush holder 33. The brush holder 33 and the cover 45 are fixed in a state being sandwiched between the motor yoke 53 and the housing.

The fixed contact plate 34 is configured to be divided in first fixed contact plate 34, and disposed inward in the radial direction which is a side closer to the commutator 61 having the switch shaft 30 interposed in between, and a second fixed contact plate 34*b* disposed outward in the radial direction which is an opposite side of the commutator 61. The first fixed contact plate 34*a* and the second fixed contact plate 34*b* are configured such that a movable contact plate 8, which is described later, is capable of striding and contacting thereto. The first fixed contact plate 34*a* and the second fixed contact plate 34*b* are electrically connected by the movable contact plate 8, contacting the first fixed contact plate 34*a* and the second fixed contact plate 34*b*.

At an outer circumferential side of the second fixed contact plate 34*b*, and a raised portion 34*c* are integrally formed with the second fixed contact plate 34*b* by bending in the axial direction. An axial terminal 44*a* is provided to protrude outwardly in the radial direction of the starter 1 penetrating an external wall of the brush holder 33 via an insertion hole 34*d* of the raised portion 34*c*. Further, a terminal bolt 44*b* to which a positive pole of a battery is connected is attached on a tip of the axial terminal 44*a* at the protruding side. The fixed contact plate 34 and the cover 45 which protects around the switch shaft 30 are attached on the brush holder 33.

In the brush holder 33, four brushes 41 are provided around the commutator 61 in a freely retractable manner in the radial direction. The brush 41 is electrically connected to an external battery (which is not shown in the drawings) to supply a power of the external battery to the commutator 61. A brush spring 42 is provided on a based end side of the each of the brush 41. Each brush 41 is biased toward the commutator 61 by the brush spring 42, and a tip of each of the brush 41 slidingly contacts with the segment 62 of the commutator 61.

Four brushes 41 are configured of two anode side brushes and two cathode side brushes. The two anode side brushes are connected to the first fixed contact plate 34*a* of the fixed contact plate 34 via a pigtail (which is not shown in the drawings). On the other hand, the positive pole of the battery (which is not shown in the drawings) is electrically connected to the second fixed contact plate 34*b* of the fixed contact plate 34 via the terminal bolt 44*b*.

That is, when the movable contact plate 8 contacts with the fixed contact plate 34, power voltage is applied on the two anode side brushed among the four brushes 41 via the terminal bolt 44*b*, the fixed contact plate 34 and the pigtail (which is not shown in the drawings), and the an electric current is supplied to the coil 59.

Further, two cathode side brushes among the four brushes 41 is connected to a ring-shaped center plate via the pigtail (which is not shown in the drawings). The two cathode side brushes among the four brushes 41 are electrically connected to a negative pole of the battery via the center plate, housing 17, and a vehicle body (which is not shown in the drawings).

In a substantially center in the radial direction of the center plate, a cylindrical part 43*b*, through which the rotating shaft 52 of the DC brush motor 51 is capable of being inserted, is integrally formed so as to protrude toward the brush holder 33 (toward the commutator 61). The commutator 61 is formed with a substantially annular groove 61*a* capable of receiving the cylindrical part 43*b*, and the cylindrical part 43*b* is disposed in the cylindrical part 43*b*. In accordance with the configuration, lubricants which is used for the planetary gear train 2 and so on, which will be described later, is prevented from entering into the DC brush motor 51 side.

A bottomed cylindrical shaped top plate 12 is provided on the motor yoke at a side opposite from the end plate 55 side. In the top plate 12, the planetary gear train 2 is provided on an inner surface at a side closer to the armature core 58.

The planetary gear train 2 is configured of a sun gear 13 integrally formed with the rotating shaft 52, a plurality of planetary gear 14 configured to mesh with the sun gear 13 and configured to revolve around the sun gear 13, and annular internally toothed ring gear 14 provided in an outer peripheral side of the planetary gears 14.

The plurality of planetary gear 14 is connected by a carrier plate 16. In the carrier plate 16, supporting shafts 16*a* are standingly provided at positions correspond to each planetary gears 14, and the planetary gears 14 are rotatably supported by the supporting shafts 16*a*. Further, in substantially center in the radial direction of the carrier plate 16, the output shaft is meshed by a serration coupling.

The internally toothed ring gear 15 is integrally formed with the top plate 12 on the inner surface of the side closer to the armature core 58. In substantially center in the radial direction of the inner periphery of the top plate 12, a sliding bearing 12*a* is provided. The sliding bearing 12*a* rotatably supports the other end edge of the output shaft 4 (left-hand side edge in FIG. 1) disposed coaxially with the rotating shaft 52.

In the top plate 12, the output shaft 4, the clutch mechanism 5, the pinion mechanism 70 and the electromagnetic equipment 9 are interiorly mounted, and a housing 17 made of Aluminum which is used to fixed the starter 1 to the engine (which is not shown) is attached on the top plate 12. The housing 17 is formed in a bottomed cylindrical shape having a bottom part 17*c* at one side in the axial direction (left-hand side in FIG. 1) and an opening 17*a* at the other side in the axial direction (right-hand side in FIG. 1) by die-casting.

The top plate 12 is connected to the housing 17 at the opening 17*a* side so that the top plate 12 closes opening 17*a*.

A female thread part 17*b* is engraved on an outer periphery of the housing 17 on a side closer to the opening 17*a* in the axial direction. Further, a bolt hole 55*a* is formed in the end plate 55 which is disposed at the other side in the axial direction of the motor yoke 53 at a position corresponds to the female thread part 17*b*. A bolt 95 is inserted into the bolt hole 55*a*, the bolt 95 is screwed in the female thread part 17*b*, and then the motor 3 and the housing 17 are integrated.

A ring-shaped stopper 94 which regulates a displacement of the clutch outer 18, which will be described later, toward the motor 3 is provided on an internal wall of the housing. The stopper 94 is made of resin or rubber, and is configured to absorb an impact force generated when the clutch outer 18 contacts.

A bottomed bearing hole 47 is formed in the bottom part 17*c* of the housing 17 coaxially with the output shaft 4. An internal diameter of the bearing hole 47 is set to be larger than an outer diameter of the output shaft 4.

Further, a sliding bearing 17*c* which rotatably supports the one side end of the output shaft 4 (left-hand side of FIG. 1) is pressed into the bearing hole 47 and is fixed. The sliding bearing 17*c* is impregnated with lubricant consists of predetermined base oil, and is configured to be smoothly slidably contacted with the output shaft 4.

In a bottom part of the bearing hole 47, a load bearing member 50 is disposed between the bottom part 17*c* of the housing 17 and the one side end face 4*c* of the output shaft 4. The load bearing member 50 is a tabular metal member, and a ring-shaped washer made by, for example, a press is capable of being adopted. The load bearing member 50 is made of material which has a property in that hardness is higher than the output shaft 4 and has high wear resistance.

Grease is applied on a circumferential of the load bearing member 50 to reduce a friction upon sliding contacting with the one side end face 4*c* of the output shaft 4. A lubricant which contains the same kind of base oil contained in a lubricant impregnated in the sliding bearing 17*d* is adopted as the grease, and thus it is configured that the lubricant of the sliding bearing 17*d* can be maintained for the long time.

A concave part 4*a* which is insertable into one end of the rotating shaft 52 (left-hand side in FIG. 1) is formed on the other end of the output shaft 4 in the axial direction (right-hand side in FIG. 1). A sliding bearing 4*b* is press fitted into the inner periphery of the concave part 4*a*, and the output shaft 4 and the rotating shaft 52 are relatively rotatably connected.

(Clutch Mechanism)

A helical spline 19 is formed in substantially middle of the output shaft 4 in the axial direction. The clutch mechanism 5 is helically meshed with the helical spline 19.

The clutch mechanism 5 includes the substantially cylindrical clutch outer 18, a clutch inner 22 formed coaxially with the clutch outer 18, and a clutch cover 6 integrally fixing the clutch inner 22.

As for the clutch mechanism 5, so-called one-way clutch function which is publicly known is adopted. That is, the clutch mechanism 5 is configured such that a rotating force from the clutch outer 18 side is transferred to the clutch inner 22 side, while a rotating force from the clutch inner 22 side is not transferred to the clutch outer 18. Accordingly, when an over-run state in which the rotating speed of the clutch inner 22 becomes higher than that of the clutch outer 18 upon staring of the engine occurs, the clutch mechanism is capable of blocking the rotating force from the ring gear 23 of the engine side.

Further, the clutch mechanism 5 is equipped with a so-called torque limiter function in which, when a torque difference and a difference in a rotating speed occur between the clutch outer 18 and the clutch inner 22 are within a predetermined range, the rotating force can be transferred, and when a torque difference and a difference in a rotating speed exceeds the predetermined range, the transfer of the rotating force is blocked.

On the other side in the axial direction of the clutch outer 18 (right-hand side in FIG. 1), a sleeve 18*a* a reduced in diameter is integrally formed. A helical spline 18*b* which meshes with the helical spline 19 is formed on an inner periphery of the sleeve 18*a*. According to this configuration, the clutch mechanism 5 is capable of slidingly movable in the axial direction with respect to the output shaft 4. Inclination angles of the helical spline 19 of the output shaft 4 and the helical spline 18*b* of the clutch outer 18 is set to, for example, approximately 16° with respect to the axial direction.

A stepped part 18*c* is formed in an inner periphery of the clutch outer 18 in one side of the sleeve 18*a* in the axial direction. An inner periphery of the stepped part 18*c* is formed to have a larger diameter than an inner periphery of the sleeve 18*a*, and in the energized state of the starter 1 (the state described below the center line of FIG. 1), a gap is formed between the inner periphery of the stepped part 18*c* and the outer periphery of the output shaft 4. In the gap, a return spring 21 which will be described later is disposed in the energized state of the starter 1. On the outer periphery 18*d* of the clutch outer 18, the clutch cover 6 is fixed by, for example, a swaging and so on.

The clutch inner 22 is formed to have an enlarged diameter larger than the sleeve 18*a* of the clutch outer 18, and in the resting state of the starter 1 (the state described above a center line of FIG. 1), a gap is formed between the clutch inner 22, the inner periphery of the stepped part 18*c* and the output shaft 4. In the gap, the return spring 21 which will be described later is disposed in the resting state of the starter 1.

On the outer periphery of the clutch inner 22, a substantially disc-shaped clutch washer 64 is outwardly fitted at a position corresponding to one side end face in the axial direction of the clutch outer 18 in the radial direction.

A regulating stepped part 22*b* is formed in one side of the clutch washer 64 in the axial direction (left-hand side in FIG. 1). The regulating stepped part 22*b* is formed by expanding the entire circumference of the outer periphery of the clutch inner 22 outwardly in the radial direction. The regulating stepped part 22*b* configures a first regulating part 97 which regulates a sliding movement amount of the pinion 74 toward the other side in the axial direction by contacting with an extension cylindrical part 74*b* formed in other side of the pinion 74 in the axial direction (right-hand side in FIG. 1).

The clutch cover 6 is a bottomed cylindrical member having a body cylindrical part 68 and a bottom wall 66 of one side of the body cylindrical part 68 in the axial direction (left-hand side if FIG. 1), and the clutch cover 6 is formed by drawing a metal plate such as an Iron.

The body cylindrical part 68 is outwardly inserted to the clutch outer 18 and the clutch washer 64, an end edge in other side of the body cylindrical part 68 in the axial direction is swaged to the end face of the clutch outer 18 on the other side in the axial direction, and then the body cylindrical part 68 is fixed to the clutch outer 18 and the clutch washer 64.

In the bottom wall 66 of the clutch cover 6, an opening which communicates the one side with the other side is formed in substantially center in the radial direction. The output shaft 4 is inserted into the opening. In the opening of the bottom wall 66, a reinforcing cylindrical part 67 extending toward the one side in the axial direction is integrally formed. An inner diameter of the reinforcing cylindrical part 67 is set to be larger than an outer diameter of the regulating stepped part 22*b*. According to this, the reinforcing cylindrical part 67 can be disposed outside of the regulating stepped part 22*b* in the radial direction without interfering with the regulating stepped part 22*b*.

A movement regulating part 20 is provided on the output shaft 4 on a side closer to the one side (left-hand side in FIG. 1) than the helical spline 19.

The movement regulating part 20 is a substantially ring-shaped member outwardly fitted on the output shaft 4, and is provided in a state that a movement toward the one side in the axial direction is regulated by a circlip 20*a*. Further, the movement regulating part 20 is set to have a larger diameter than the inner periphery of the stepped part 18*c* so as to be capable of interfering with the stepped part 18*c* formed in the clutch outer 18.

When the clutch mechanism 5 slidingly moves toward the one side in the axial direction, it is configured that the stepped part 18*c* of the clutch outer 18 and the movement regulating part 2 interferes each other. According to this, sliding movement amounts of the clutch mechanism 5 and the pinion mechanism 70 toward the one side in the axial direction is regulated.

In between the movement regulating part 20 and the sleeve 18*a* of the clutch outer 18, and further in between the inner periphery of the stepped part 18*c* and the outer periphery of the output shaft 4, the return spring 21 formed so as to surround the output shaft 4 is provided in a compressively deformed state. According to this, the clutch outer 18 is in a state that the clutch outer 18 is always biased to be pushed back toward the motor 3.

In the clutch mechanism 5 formed in this way, the pinion mechanism 70 is integrally provided in a tip of the clutch inner 22.

(Pinion Mechanism)

The pinion mechanism 70 includes a cylindrical pinion inner 71 integrally formed with the clutch inner 22 at a tip thereof, and a pinion 74 coaxially provided with the pinion inner 71 outward in the radial direction of the pinion inner 71.

In an inner periphery of the pinion 71, two sliding bearings 72 are provided on both sides in the axial direction to slidably support the pinion inner 71 on the output shaft 4.

In an outer periphery of the pinion inner 71, a pinion inner-side helical external teeth 73 is formed at a tip end side opposite to the clutch mechanism 5. The pinion 74 which is capable of meshing with the ring gear 23 of the engine (which is not shown) is outwardly fitted on the pinion inner-side helical external teeth 73.

The pinion 74 includes a pinion-side helical external teeth 74A meshing with the teeth part 23A of the ring gear 23, and a pinion side helical internal teeth 74*a* meshing with the pinion inner-side helical external teeth 73 of the pinion inner 71.

The teeth part 23A of the ring gear 23 and the pinion-side helical external teeth 74A of the pinion 74 have twisting angle in a predetermined direction, respectively. The twisting direction of the pinion-side helical external teeth 74A is defined based on the twisting direction of the teeth part 23A of the ring gear 23. Specifically, upon meshing of the pinion 74 and the ring gear 23, the twisting angle is set so that a thrust load is generated on the pinion 74 in a direction approaching to the ring gear 23 (jump-in direction).

The pinion inner-side helical external teeth 73 of the pinion inner 71 and the pinion-side helical internal teeth 74*a* of the pinion 74 have a twisting angle in a predetermined direction, respectively. Specifically, upon meshing of the pinion and the ring gear 23, the twisting angle is set so that a thrust load is generated on the pinion 74 in a direction away from the ring gear 23 (separating direction).

The twisting direction of the pinion inner-side helical external teeth 73 is set to be the same with the twisting direction of the pinion-side helical external teeth 74A of the pinion 74. Accordingly, a direction of the thrust load generated on a meshing portion between the pinion 74 and the ring gear 23 is opposite to a direction of the thrust load generated on a meshing portion between the pinion 74 and the ring gear 23. According to this, when the rotating speed of the pinion 74 is lower than that of the ring gear 23, the pinion 74 can be reliably separated in a direction away from the ring gear 23 upon contacting of end faces of the pinion 74 and the ring gear 23. Further, as the pinion 74 goes down along the helical of the pinion inner 71, an impact force generated upon contacting of end faces can be absorbed, and wears of parts upon meshing between the pinion and the ring gear can be suppressed. When the rotating speed of the pinion 74 is higher than that of the ring gear 23, the pinion 74 can reliably mesh with the ring gear. Accordingly, the life-time can be further prolonged while maintaining preferable linkage between the ring gear 23 and the pinion 74.

In the inner periphery of the pinion 74, an enlarged diameter part 75 is formed at a rear end of the pinion-side helical internal teeth 74*a* in which a diameter is enlarged intervening the stepped part 74*c*. A housing portion 76 is formed between the pinion inner 71 and the pinion 74.

The opening formed at a side of the housing portion 76 closer to the clutch mechanism 5 is closed by the stepped part 71*a* provided on a base end side of the clutch inner 22. That is, the pinion 74 is in a state in which the pinion 74 is slidably supported in the axial direction by the pinion inner 71. According to this, the pinion 74 can slidingly move in the axial direction with respect to the pinion inner 71 without having a significant backlash.

In the housing portion 76, a pinion spring 11 formed so as to surround the outer periphery of the pinion inner 71 are housed. The pinion spring 11 is compressively deformed by the stepped part 74*c* of the enlarged diameter part 75 of the pinion 74 and the stepped part 71*a* of the pinion inner 71 in a state to be housed inside the housing portion 76. According to this, the pinion 74 is in a state that the pinion 74 is biased toward the ring gear 23 with respect to the pinion inner 71.

The pinion spring 11 functions as a damper mechanism which elastically deforms in the axial direction when the pinion 74 and the ring gear 23 contacts to absorb an impact force. According to this, wears of the pinion 74 and the ring gear 23 is suppressed, and thus life-spans of the pinion 7 and the ring gear 23 is prolonged.

In an end face of the pinion 74 in the other side in the axial direction (right-hand side in FIG. 1), an extension cylindrical part 74*d* extending toward the other side in the axial direction is provided. The extension cylindrical part 74*d* is formed concentrically with the output shaft 4. The extension cylindrical part 74*d* is configured such that when the pinion spring 11 elastically deforms and the pinion 74 slides toward the other side of the pinion 74 in the axial direction (right-hand side in FIG. 1), the extension cylindrical part 74*d* is capable of contacting with the regulating stepped part 22*b* of the clutch inner 22.

That is, the extension cylindrical part 74*d* of the pinion 74 and the regulating stepped part 22*b* of the clutch inner 22 configure the first regulating part 97 regulating a movement of the pinion toward the other side in the axial direction by mutually contacting.

An external diameter of the extension cylindrical part 74*d* is set to be smaller than a diameter of the opening 66*a* of the clutch cover 6 and an inner diameter of the reinforcing cylindrical part 67. According to this, although the pinion 74 moves toward the other side in the axial direction, the extension cylindrical part 74*d* can contact the regulating stepped part 22*b* without interfering with the clutch cover 6.

Here, a maximum meshing margin L1 between the ring gear 23 and the pinion 74 in the energized state (lower part of the FIG. 1), and a spacing distance L2 between the extension cylindrical part 74*d* of the pinion 74 configuring the first regulating part 97 and the regulating stepped part 22*b* of the clutch inner 22 are set to satisfy a relation of;

$$L1 > L2 \quad (1)$$

By configuring in this way, although the pinion slides in a direction away from the ring gear 23 with the spacing distance L2 of the pinion spring 11, the meshing between the pinion 74 and the ring gear 23 is not to be released.

Further, in the one side of the pinion inner 71 in the axial direction (left-hand side in FIG. 1), a snap ring 77 outwardly fitted on the output shaft 4 is provided. According to this, the pinion 74 is prevented from dropping off to one side of the output shaft 4 with respect to the pinion inner 71.

(Electromagnetic Equipment)

In the inner periphery of the housing 17, a yoke 25 configuring the electromagnetic equipment 9 is inwardly fitted at a side closer to the motor 3 than the clutch mechanism 5. The yoke 25 is formed in a bottomed cylindrical shape made of magnetic material, and a large part of substantially center in the radial direction of a bottom part 25*a* is widely opened.

On an end of the yoke 25 opposite from the bottom part 25*a*, an annular plunger holder 26 made of magnetic material is provided. The plunger holder 26 is a member in which a holder body part 26*a* formed in substantially annular shape so as to correspond to the bottom part 25*a* of the yoke 25 and a holder cylindrical part 26*b* bent extended from an inner circumferential edge of the holder body part 26*a* toward the other side in the axial direction are integrally formed. Because of the holder cylindrical part 26*b*, a spacing distance between an iron core 88 of a gear plunger 80 is reduced, and a suctioning force of the iron core 88 by the plunger holder 26 can be increased.

An exciting coil 24 formed in substantially cylindrical shape is housed in a housing concave part 25*b* formed by the yoke 25 and the plunger holder 26 inward in the radial direction. The exciting coil 24 is electrically connected to an ignition switch via a connector (both are not shown in the drawings).

In a gap between an inner periphery of the exciting coil 24 and the outer periphery of the output shaft 4, a plunger mechanism 37 is slidably provided in the axial direction with respect to the exciting coil 24.

The plunger mechanism 37 includes a substantially cylindrical switch plunger 27 formed of magnetic material and a gear plunger 80 disposed in a gap between the switch plunger 27 and the outer periphery of the output shaft 4. The switch plunger 27 and the gear plunger 80 are provided coaxially each other, and are provided slidingly movable win the axial direction. In between the plunger holder 26 and the switch plunger 27, a switch return spring 27*b* configured of leaf spring material which biases both of them in a direction separating each other.

On an end of the switch plunger 27 closer to the motor 3, an external flange part 29 is integrally formed. In an outer circumferential side of the external flange part 29, a switch shaft 30 penetrating the top plate 12 of the motor 3 is provided in the axial direction via a holder member 30*a* and a through hole 43*a* of the center plate. The switch shaft 30 penetrate the top plate 12 of the motor 3 and a brush holder 33 which will be described later. On an end of the switch shaft protruding from the top plate 12, the movable contact plate 8 disposed adjacent to the commutator 61 of the DC brush motor 51 is connected.

The movable contact plate 8 is slidably attached in the axial direction with respect to the switch shaft 30, and is floatingly held by a switch spring 32. Further, the movable contact plate 8 is configured to be freely approaching to and/or away from the fixed contact plate 34 of the switch unit 7 fixed on the brush holder 33.

That is, the movable contact plate 8 contacts the first fixed contact plate 34*a* and the second fixed contact plate 34*b* configuring the fixed contact plate 34 so as to stride. The movable contact plate 8 strokes along the output shaft 4 to contact with the first fixed contact plate 34*a* and the second fixed contact plate 34*b*, the first fixed contact plate 34*a* and the second fixed contact plate 34*b* are in a turned-on state and are electrically connected.

In the inner periphery of the switch plunger 27, a ring member 28 contacts with and/or separating from the gear plunger 80, which will be described later, is integrally provided. The ring member 28 is a member to initially press the gear plunger 80 toward the ring gear 23 as the switch plunger 27 moves toward the ring gear 23.

The clutch outer 18 of the clutch mechanism 5 is biased toward the plunger inner 81 by the return spring 91. Accordingly, in the resting state of the starter 1 (above the center line in FIG. 1), the clutch mechanism 5 press the switch plunger 27 toward the other side (right-hand side in FIG. 1) intervening the gear plunger 80 and the ring member 28. According to this, the movable contact plate 8 is pressed toward the other side, and is in a turned-off state that is away from the fixed contact plate 34.

Here, a spacing distance between the movable contact plate 8 and the fixed contact plate 34 in the resting state of the starter 1 (above the center line in FIG. 1), that is, a stroke amount of the movable contact plate 8 in the axial direction when the movable contact plate 8 changes from the turned-off state into the turned-on state is set as L3, and a maximum spacing distance between the ring gear 23 and the pinion 74 is set as L4, the stroke amount L3 and the maximum spacing distance L4 are set to satisfy the following relationship;

$$L3>L4 \quad (2)$$

Accordingly, when the electromagnetic equipment 9 slides the pinion 74 and the movable contact plate 8 toward the one side in the axial direction (left-hand side in FIG. 1), the pinion 74 contacts the ring gear 23 before the movable contact plate 8 is in the turned-on state.

The gear plunger 80 disposed radially inward of the switch plunger 27 includes a plunger inner 81 disposed radially inward, a plunger outer 85 disposed radially outward, and a plunger spring 91 disposed between the plunger inner 81 and the plunger outer 85.

The plunger inner 81 is formed in substantially cylindrical shape made of resin and so on. An inner diameter of the plunger inner 81 is formed slightly larger than an outer diameter of the output shaft 4 so as to be capable of outwardly fitted on the output shaft 4. According to this, the plunger inner 81 is slidably provided in the axial direction with respect to the output shaft 4.

On a one side end 81*a* of the plunger inner 81 in the axial direction (left-hand side in FIG. 1), an external flange part 82 expanding radially outward is integrally formed. When the plunger inner 81 slides toward the one side in the axial direction, the one side end 81*a* of the plunger inner 81 in the axial direction contacts the other side end of the clutch outer 18 in the axial direction, and slides the clutch mechanism 5 and the pinion mechanism 70 toward the one side in the axial direction.

On the other side end 81*b* of the plunger inner 81 in the axial direction (right-hand side in FIG. 1), a plurality of claw part 83, each of which has an outer diameter gradually increases from the other side in the axial direction toward the one side in the axial direction are formed in a circumferential direction. Further, on one side of the claw part 83 in the axial direction (left-hand side in FIG. 1), a groove 84 is formed in the circumferential direction.

The plunger outer 85 is formed in substantially cylindrical shape made of resin and so on in the same manner with the plunger inner 81. An inner diameter of the plunger outer 85 is set to be slightly larger than an outer diameter of the external flange part 82 of the plunger inner 81, and the plunger outer 85 is outwardly fitted on the plunger inner 81.

On an end 85*a* of the plunger 85 on the other side in the axial direction (right-hand side in FIG. 1), an inner flange part 86 expanded radially inward is integrally formed.

An inner diameter of the inner flange part 86 is set so as to be smaller than an outer diameter of the claw part 83 of the plunger inner 81, and to be larger than an outer diameter of the bottom part of the groove 84 of the plunger inner 81. The inner flange part 86 of the plunger outer 85 is disposed in the groove 84 of the plunger inner 81, the plunger inner 81 and the plunger outer 85 is integrated, and thus the plunger mechanism 37 is configured.

A thickness of the inner flange part 86 of the plunger outer 85 is set to be thinner than a width of the groove 84 of the plunger inner 81. According to this, a clearance is provided between the inner flange part 86 of the plunger outer 85 and the groove 84 of the plunger inner 81. Accordingly, the plunger inner 81 and the plunger outer 85 are slidingly movable relatively in the axial direction with the amount of clearance between the inner flange part 86 of the plunger outer 85 and the groove 84 of the plunger inner 81.

On an end 85*a* of the plunger outer 85 on the other side in the axial direction (right-hand side in FIG. 1), an external flange part 87 expanded radially outward is integrally formed. The external flange part 87 functions as the contacting part contacting with the ring member 28 of the switch plunger 27.

Further, the ring-shaped iron core 88 is provided on the one side of the external flange part 87 in the axial direction (left-hand side in FIG. 1) and on the outer periphery of the plunger outer 85. The iron core 88 is integrally formed with the plunger outer 85 by, for example, resin molding. The iron core 88 is suctioned by a magnetic flux generated when a power is supplied to the exciting coil 24.

A housing portion 90 is formed between the external flange part 82 of the plunger inner 81 and the inner flange part 86 of the plunger outer 85. In the housing portion 90, a plunger spring 91 formed so as to surround the outer periphery of the plunger inner 81 is housed.

The plunger spring 91 is compressively deformed by the external flange part 82 of the plunger inner 81 and the inner flange part 86 of the plunger outer 85 in a state to be housed inside the housing portion 90. And then, the plunger inner 81 is biased toward the one side in the axial direction (left-hand side in FIG. 1), and the plunger outer 85 is biased toward the other side in the axial direction (right-hand side in FIG. 1).

Under this configuration, in the resting state of the starter 1 (the state described above the center line in FIG. 1), the plunger inner 81 is biased toward the one side in the axial direction by the plunger spring 91, while the plunger outer 85 is biased toward the other side (right-hand side in FIG. 1).

The one side end 81*a* of the plunger inner 81 in the axial direction and the other side end of the clutch outer 18 do not contact each other, and therefore, the clutch outer 18 is in a state of being pressed toward the stopper 94 by a spring load of the return spring. Accordingly, in the resting state of the starter 1, it is configured that the clutch mechanism 5 is not pressed out by the spring load of the plunger spring 91, i.e. the pinion mechanism 70 is prevented from being pressed out unintentionally.

In the energized state of the starter 1 (the state below the center line in FIG. 1), when the gear plunger 80 is displaced maximally toward the one side in the axial direction (left-hand side in FIG. 1), the one side end 81*a* of the plunger inner 81 on the one side in the axial direction is in a state to always contact with the other side end of the clutch outer 18 of the clutch mechanism 5 in the axial direction. That is, the plunger spring 91 configures a backlash absorption mechanism which prevents a generation of a gap in the axial direction between the clutch mechanism 5 and the gear plunger 80, and absorbs a backlash of the clutch mechanism 5.

(Operation of the Starter)

Next, an operation of the starter 1 will be described with reference to each of FIGS. 1 to 4C.

As a state indicated above the center line in FIG. 1, in the resting state before a power is supplied to the exciting coil 24, the clutch outer 18 biased by the return spring 21 is maximally biased toward the motor 3 (right-hand side in FIG. 1) in a state that the clutch outer 18 pulls the clutch inner 22 integrated with the pinion 74. And then, the clutch outer 18 of the clutch mechanism 5 is stopped at a position contacting with the stopper 94, and a connection of the pinion 74 and the ring gear 23 is broken while having the maximum spacing distance L4.

In the resting state of the starter 1, a slight clearance is given between the one side end 81*a* of the plunger inner 81 in the axial direction and the other side end of the clutch outer 18 in the axial direction.

According to this, the clutch outer 18 is in a state of being pressed toward the stopper by the spring load of the return spring 21. Accordingly, in the resting state of the starter 1, it is configured that the clutch mechanism 5 is not pressed by the spring load of the plunger spring 91, i.e. the pinion mechanism 70 is prevented from being pressed out toward the ring gear 23 unintentionally.

Further, the switch plunger 27 is pressed back by the switch return spring 27*b* and is displaced maximally toward the motor 3 (right-hand side in FIG. 1). And then, the switch plunger 27 is stopped in a state that the external flange part 29 contacts the top plate 12. Further, the movable contact plate 8 of the switch shaft 3 provided in the external flange part 29 is away from the fixed contact plate 34 with the distance L3 (e.g. the stroke amount L3 of the movable contact plate 8), and the movable contact plate 8 is electrically disconnected from the fixed contact plate 34.

Figure 2A:
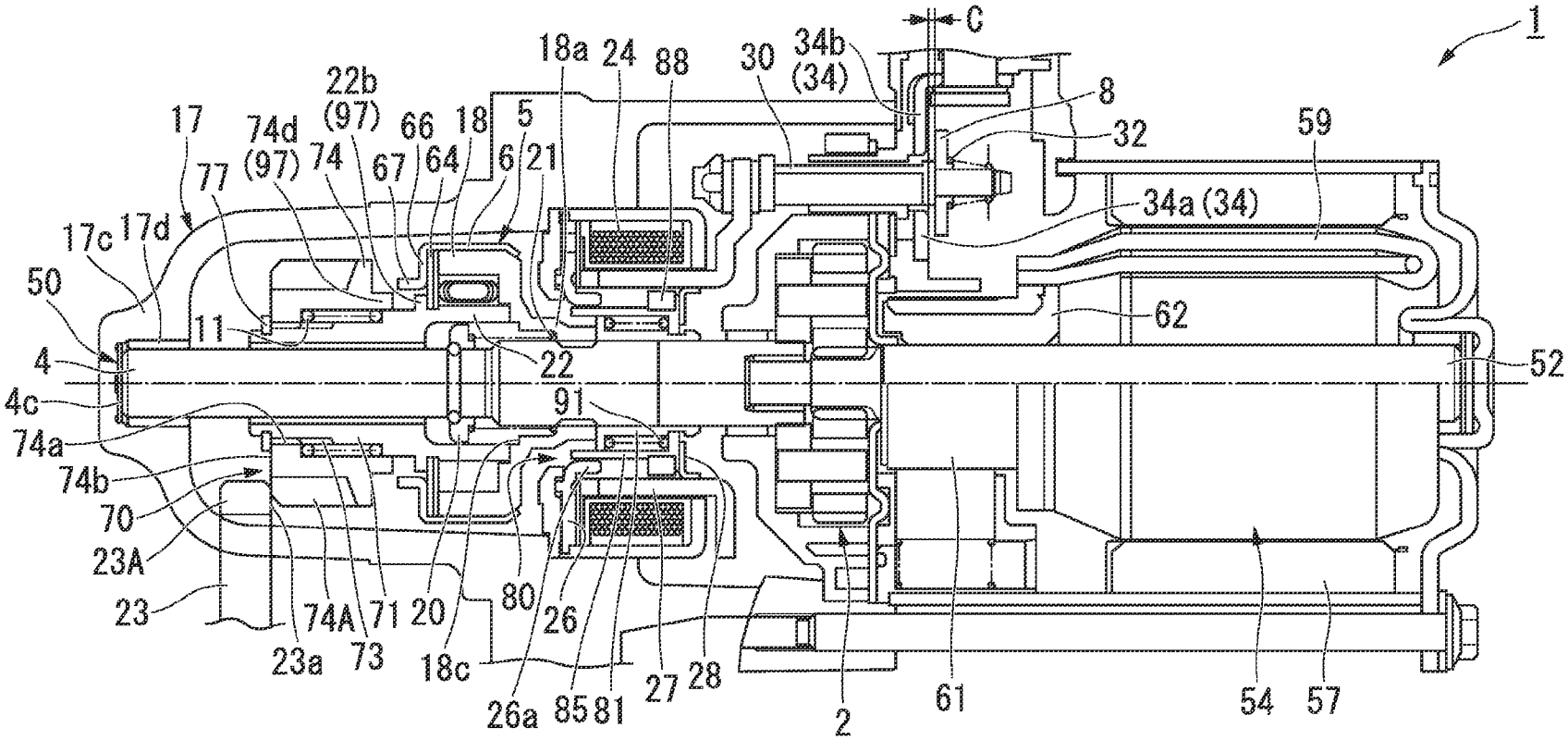
FIG. 2A is an explanatory diagram of a switch plunger immediately after a movement.
Figure 2B:
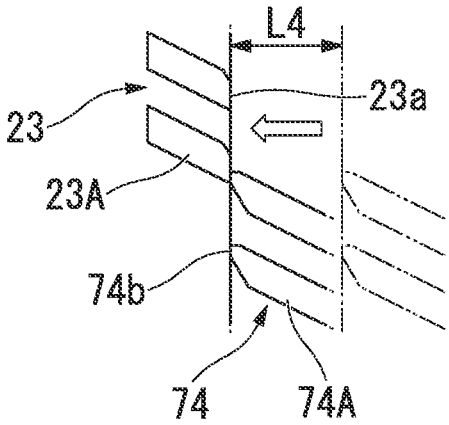
FIG. 2B is an explanatory diagram of the switch plunger immediately after the movement.
Figure 2C:
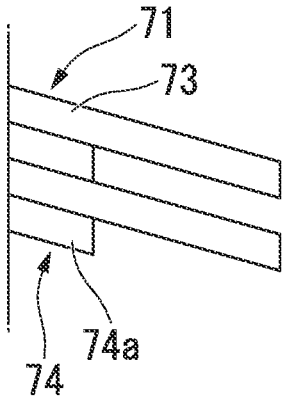
FIG. 2C is an explanatory diagram of the switch plunger immediately after the movement.

FIGS. 2A, 2B and 2C show explanatory diagram of the switch plunger 27 immediately after movements. FIG. 2A shows an operation of the starter 1, FIG. 2B shows an operation of the pinion 74 with respect to the ring gear 23, and FIG. 2C shows an operation of the pinion 74 with respect to the pinion inner 71. Further, FIGS. 2B and 2C are schematic diagrams when seen the pinion 74 and the ring gear 23 in the radial direction, and a rotating direction of the pinion 74 and the ring gear 23 is an upside in FIGS. 2B and 2C. In FIG. 2B, the pinion 74 before the movement is indicated by two-dot chain line.

As shown in FIG. 2A, when an ignition switch (not shown) of a vehicle is turned on in a state immediately after a movement of the switch plunger 27, a power is supplied to the exciting coil 24 and is excited, and a magnetic path in which a magnetic flux passes the switch plunger 27 and the gear plunger 80. According to this, the switch plunger 27 and the gear plunger 80 slides toward the ring gear 23 (left-hand side of FIG. 2A).

As shown in FIG. 1, in the resting state of the starter 1, a gap (axial clearance) between the switch plunger 27 and the plunger holder 26 is set to be smaller than a gap (axial clearance) between the iron core 88 of the gear plunger and the plunger holder 26. For this reason, if a suctioning force generated in the switch plunger 27 is larger than a suctioning force generated in the gear plunger 80, then switch plunger moves prior to the gear plunger.

At this time, since the ring member 28 is integrally provided in the inner periphery of the switch plunger 27, the ring member 28 presses the gear plunger 80, the gear plunger 80 is initially pressed toward the ring gear 23, the switch plunger 27 and the gear plunger 80 slides integrally toward the ring gear 23.

The clutch outer 18 is meshed with the output shaft 4 in the helical spline meshing, and the sleeve 18*a* contacts with the plunger inner 81 of the gear plunger 80. Here, inclination angles of the helical spline 19 of the output shaft 4 and the helical spline 18*b* of the clutch outer 18 is set to, for example, 16° with respect to the axial direction.

Accordingly, as shown in FIG. 2A, when the switch plunger 27 and the gear plunger 80 slides toward the ring gear, the clutch outer 18 is pressed out while slightly relatively rotating with the amount corresponding to the inclination angle of the helical spline 18*b* with respect to the output shaft. Further, the pinion mechanism 70 works with the sliding movement of the gear plunger 80 via the clutch mechanism 5, and is pressed out toward the ring gear 23.

At this time, as shown in FIG. 2B, the pinion 74 moves toward the ring gear 23 with the predetermined distance. Then, the one side end face 74*b* of the pinion 74 (left-hand side in FIG. 2B) and the other side end face 23*a* of the ring gear 23 (right-hand side in FIG. 2B) contact each other, or a spacing distance in between in the axial direction is equal to zero.

Further, since the switch plunger 27 slides toward the ring gear 23 integrally with the gear plunger 80, the switch plunger 27 and the movable contact plate 8 working with the switch plunger 27 moves toward the one side in the axial direction with the maximum spacing distance L4.

As shown in FIG. 2C, although the pinion 74 fits the pinion inner 71 as the helical spline fitting, the pinion 74 is biased toward the ring gear 23 by the pinion spring 11 (refer to FIG. 2A). Accordingly, the pinion 74 is maintained immediately before contacting with the ring gear 23 without relative movement with respect to the pinion inner 71.

Here, as previously described, the stroke amount Le of the movable contact plate 8 (refer to FIG. 3) and the maximum spacing distance L4 between the ring gear 23 and the pinion 74 are set to satisfy the following relationship:

$$L3>L4 \quad (2)$$

Accordingly, even for a case to move toward the one side in the axial direction (left-hand side in FIG. 2A) with the maximum spacing distance L4 between the pinion 74, the movable contact plate 8 is in a turned-off state while having a clearance C (refer to FIG. 2A) equal to a difference between the stroke amount L3 and the maximum spacing distance L4. That is, before the movable contact plate 8 is in a turned-on state, the one side end face 74*b* of the pinion 74 in the axial direction and the other side end face 23*a* of the ring gear 23 in the axial direction contact each other, or a spacing distance in between in the axial direction becomes zero.

Figure 3A:
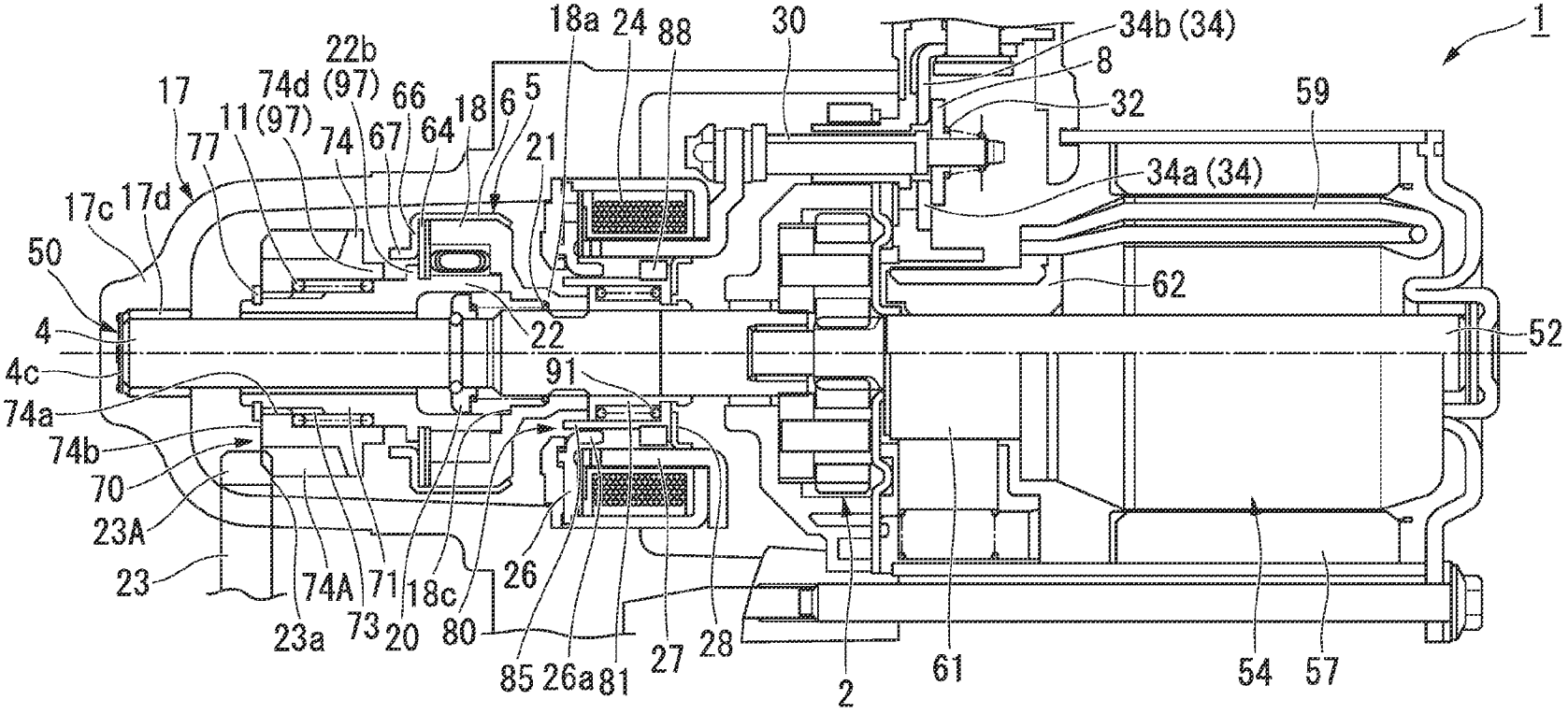
FIG. 3A is an explanatory diagram when a movable contact palate contacts a fixed contact plate.
Figure 3B:
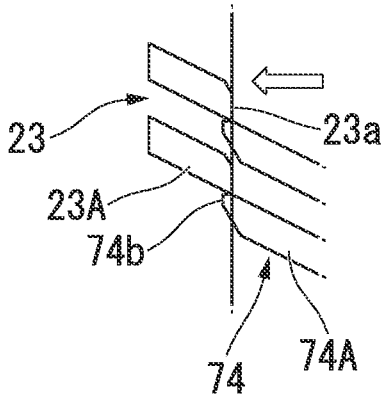
FIG. 3B is an explanatory diagram when the movable contact palate contacts the fixed contact plate.
Figure 3C:
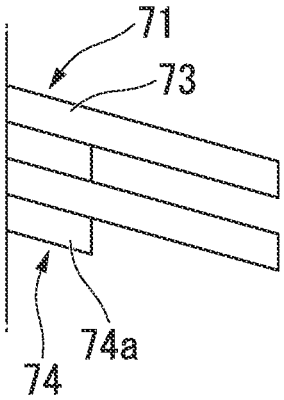
FIG. 3C is an explanatory diagram when the movable contact palate contacts the fixed contact plate.

FIGS. 3A, 3B and 3C show explanatory diagrams when the movable contact palate contacts the fixed contact plate. FIGS. 3A to 3C follow FIG. 3A are drawings correspond to FIGS. 2A to 2C, respectively.

As shown in FIG. 3A, when the switch plunger 27 is suctioned by the plunger holder 26 and slides toward the ring gear 23, a cylindrical part 27*a* of the switch plunger 27 and a holder cylindrical part 26*b* of the plunger holder 26 are in a state overlapping in the radial direction. For this reason, the magnetic flux between the holder cylindrical part 26*b* and the cylindrical part 27*a* of the switch plunger 27 increases, and a magnetic force of the exciting coil 24 to the switch plunger 27 becomes large. Accordingly, a state that the switch plunger 27 slidingly moves is reliably maintained.

Further, when the switch plunger is suctioned and slides toward the ring gear 23, the stroke amount L3 (refer to FIG. 1) of the movable contact plate 8 becomes maximum. Then, the movable contact plate 8 contacts the fixed contact plate 34. Since the movable contact plate 8 is floatingly supported so as to be displaceable with respect to the switch shaft 30 in the axial direction, a pressing force of the switch spring 32 is applied on the movable contact plate 8 and the fixed contact plated 34.

At this time, in a case that the one side end face 74*b* of the pinion 74 in the axial direction and the other side end face 23 of the ring gear 23 in the axial direction contact each other, when the pinion mechanism 70 is further pressed out by the switch plunger 27, the pinion spring 11 is compressed. According to this, the one side end face 74*b* of the pinion 74 in the axial direction is biased toward the other side end face 23*a* of the ring gear 23 in the axial direction.

That is, the pinion spring 11 functions as a damper mechanism which absorbs the thrust load generating upon the pinion 74 contacts the ring gear. Accordingly, even in a state that the one side end face 74*b* of the pinion 74 in the axial direction and the other side end face 23*a* of the ring gear in the axial direction contact each other, it is possible to press the switch plunger 27 out to a predetermined position, and further, wears of the one side end face 74*b* of the pinion 74 in the axial direction and the other side end face 23*a* of the ring gear can be suppressed, thereby life-span of the pinion 74 and the ring gear 23 can be prolonged.

Subsequently, when the movable contact plate 8 contacts the fixed plated 34, the coil 59 is energized and a magnetic field occurs in the armature core 58, and then magnetic suctioning force and/or repulsive force are generated between the magnetic field and the permanent magnet 57 provided in the motor yoke 53. And then, the armature 54 rotates, the rotating force of the rotating shaft 52 of the armature 54 is transferred to the output shaft 4 via the planetary gear train 2, and the output shaft 4 starts to rotate.

As the output shaft 4 starts to rotate, if the one side end face 74*b* of the pinion 74 in the axial direction has contacted with the other side end face 23*a* of the ring gear 23 in the axial direction, the contacting state is released (refer to FIG. 2B). And then, as shown in FIG. 3B, the pinion 74 is pressed out toward the ring gear 23 by the biasing force of the pinion spring 11.

Figure 4A:
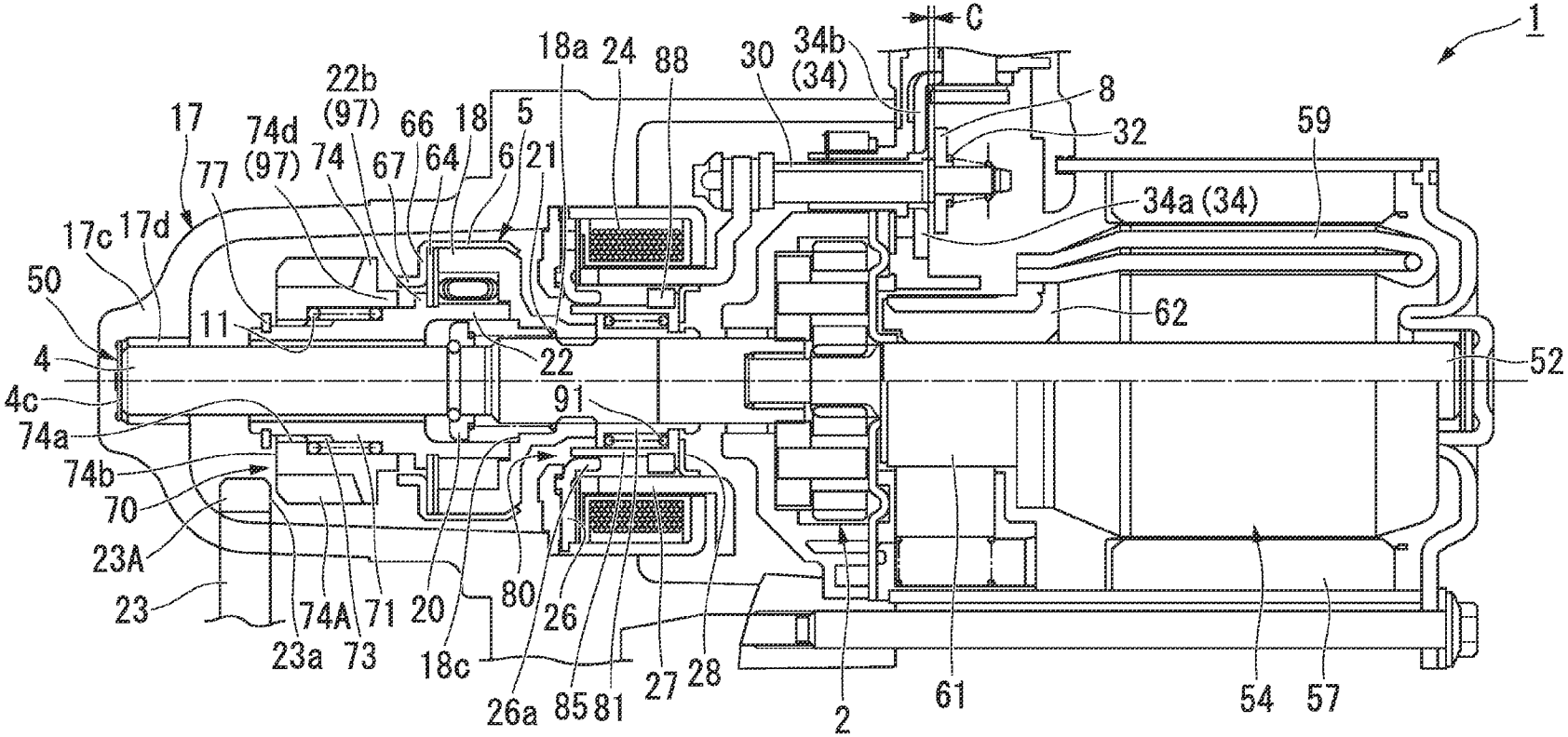
FIG. 4A is an explanatory diagram when a pinion collides with a ring gear.
Figure 4B:
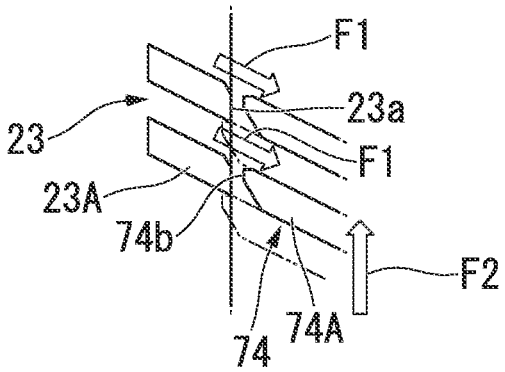
FIG. 4B is an explanatory diagram when the pinion collides with the ring gear.
Figure 4C:
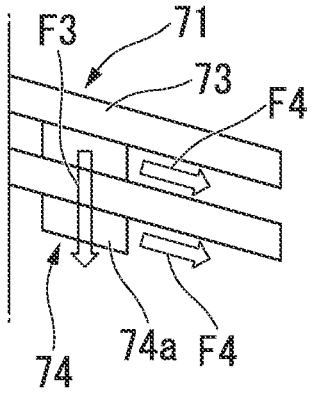
FIG. 4C is an explanatory diagram when the pinion collides with a ring gear.

FIGS. 4A, 4B, and 4C show explanatory diagrams when the pinion 74 collides with a ring gear 23.

Upon meshing between the pinion 74 and the ring gear 23, generally, a relative difference in rotating speed occurs between the pinion 74 and the ring gear 23. For example, in an automobile which equips an idling stop function, there may be a case in which an engine is restarted immediately after stopping a fuel injection of the engine. In this case, since the ring gear 23 is rotating by an inertial rotation, the relative difference in the rotating speed exists between the pinion 74 and the ring gear 23.

As shown in FIG. 4B, for example, in case that the rotating speed of the ring gear 23 is higher than that of the pinion 74, a tip corner of the teeth part 23A of the ring gear 23 collides with a tip corner of the pinion-side helical external teeth 74A of the pinion. Thereby, a thrust load F1 is generated on the pinion 74 in a direction away from the ring gear 23 along the helical angle of the teeth part 23 of the ring gear 23 and the pinion-side helical external teeth 74A of the pinion 74.

At this time, since the ring gear 23 is rotating with the predetermined rotating speed, the pinion 74 collides with the ring gear 23 receives the thrust load F1, while an rotating force F2 is applied in a rotating direction of the ring gear 23 by the ring gear 23 which is rotating.

Further, as shown in FIG. 4C, a collision reaction force load F3 is generated on the pinion 74 caused by a collision in a direction opposite from a rotating direction of the pinion 74 between the pinion inner-side helical external teeth 73 of the pinion inner 71 and the pinion-side helical internal teeth 74*a* of the pinion. Further, a vector of the collision reaction force load F3 is divided along the helical angle of the pinion inner-side helical external teeth 73 and the pinion-side helical internal teeth 74*a*, and then a thrust load F4 directing a direction away from the ring gear 23 is generated. Thereby, the pinion 74 moves in a direction away from the ring gear 23.

As shown in FIG. 4A, the pinion spring 11 compresses in accordance with a movement amount of the pinion in the axial direction. That is, the pinion spring 11 functions as a damper mechanism which absorbs a thrust load generated upon collision between the pinion 74 and the ring gear 23. Accordingly, even in a collision between the pinion 74 and the ring gear 23, wears of the one side end face 74*b* of the pinion 74 in the axial direction and the other side end face 23*a* of the ring gear 23 in the axial direction can be suppressed, and life-spans of the pinion 74 and the ring gear 23 can be prolonged.

Further, a state in which the tip corner of the teeth part 23A of the ring gear 23 collides with the tip corner of the pinion-side helical external teeth 74A of the pinion 74, which is shown in FIG. 4B, occurs again, the pinion 74 receives the rotating force F2 from the ring gear 23. The rotating speed of the pinion 74 is accelerated each time the states occurs, eventually the rotating speed of the pinion reaches the rotating speed of the ring gear 23, and then the rotation of the pinion 74 synchronizes with the rotation of the ring gear.

Figure 5A:
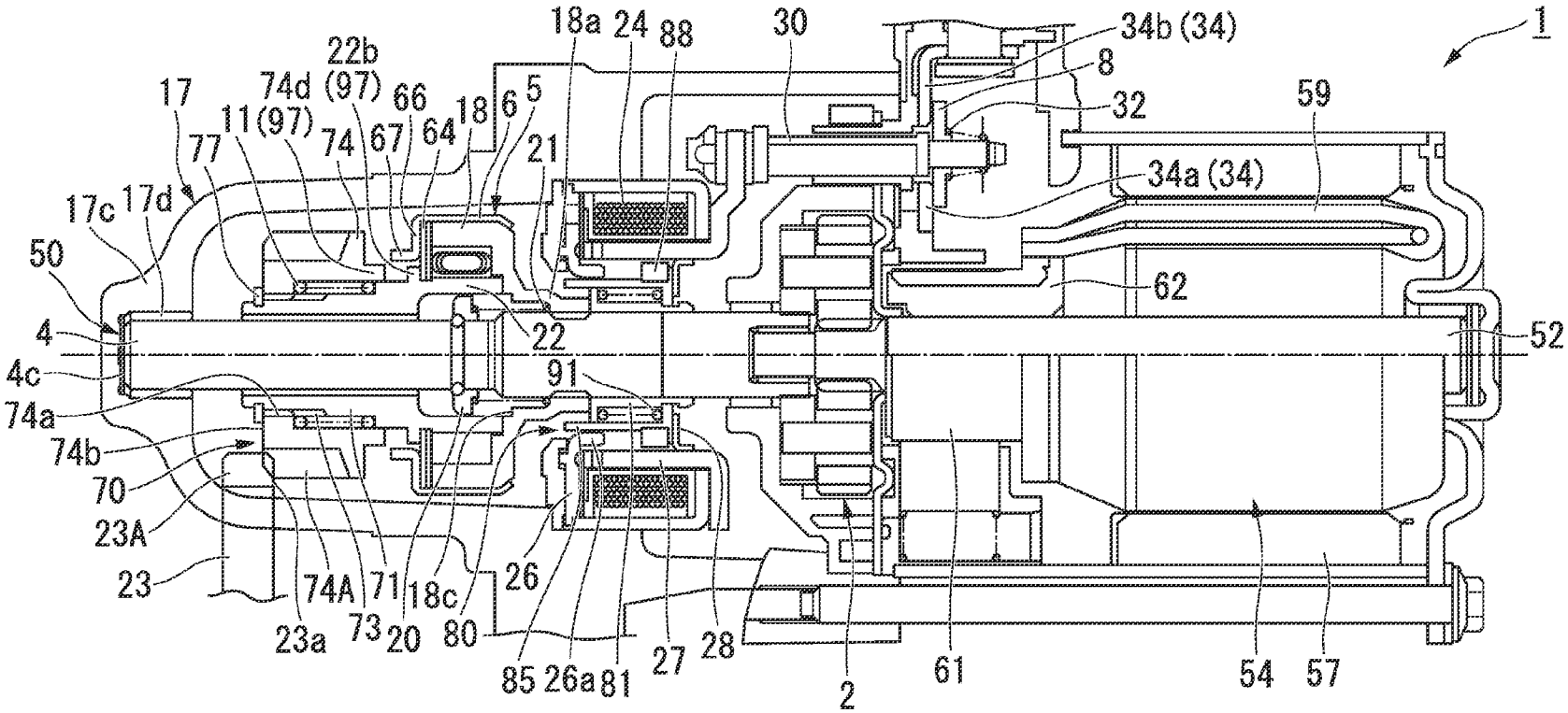
FIG. 5A is an explanatory diagram when a pinion stats to mesh with a ring gear.
Figure 5B:
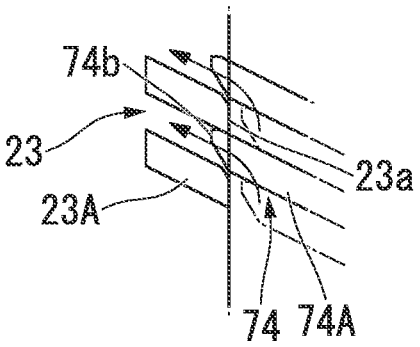
FIG. 5B is an explanatory diagram when the pinion stats to mesh with the ring gear.
Figure 5C:
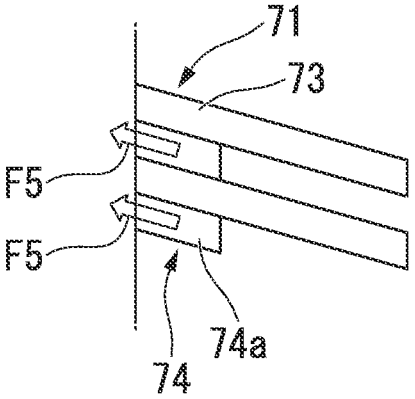
FIG. 5C is an explanatory diagram when a pinion stats to mesh with a ring gear.

FIGS. 5A, 5B and 5C shown explanatory diagrams when the pinion 74 starts to mesh with the ring gear 23.

As shown in FIG. 5C, a pressing force acts on the pinion 74 in a direction approaching to the ring gear by the biasing force of the compressed pinion spring 11. Further, by a rotation of the output shaft 4 (refer to FIG. 5A), the rotating speed of the pinion 74 becomes the same with the rotating speed of the ring gear 23 (synchronized state), or becomes much higher than the rotating speed of the ring gear 23. Once the ring gear 23 starts to mesh with the pinion 74, the pinion 74 moves in a direction approaching to the ring gear 23 along the helical angle of the pinion-inner side helical external teeth 73 and the pinion-side helical internal teeth 74*a* by a thrust load F5 generated by the meshing between the pinion 74 and the ring gear 23.

And then, as shown in FIG. 5B, the pinion 74 pressed out toward the ring gear 23 starts to mesh with the ring gear 23.

Figure 6A:
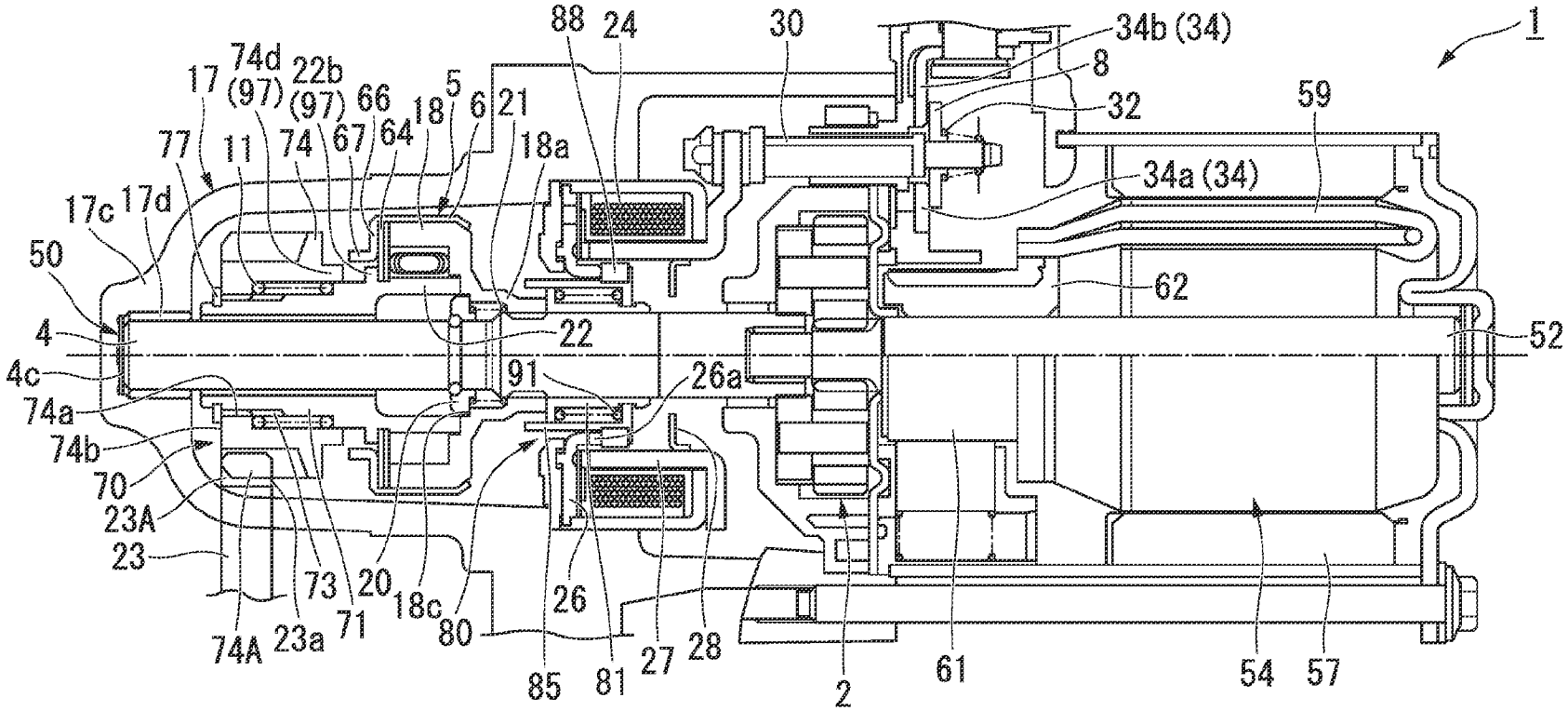
FIG. 6A is an explanatory diagram when a pinion meshes with a ring gear.
Figure 6B:
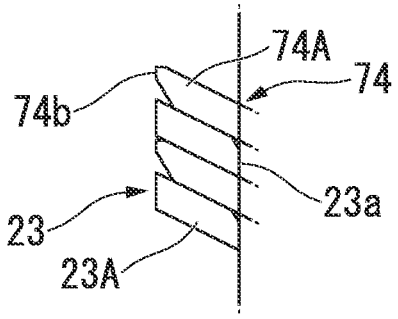
FIG. 6B is an explanatory diagram when the pinion meshes with the ring gear.
Figure 6C:
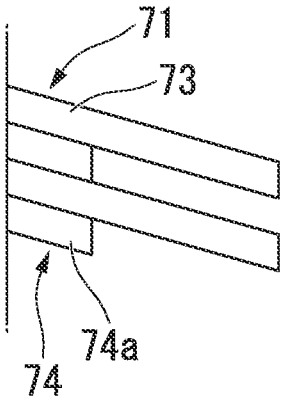
FIG. 6C is an explanatory diagram when the pinion meshes with the ring gear.

FIGS. 6A, 6B and 6C are explanatory diagrams when the pinion 74 meshes with the ring gear 23.

As the rotating speed of the output shaft 4 increases, an inertial force acts on the clutch outer 18 meshed with the helical spline 19 of the output shaft 4. At this time, since the pinion 74 is meshed with the ring gear 23 by the helical meshing, and fitted with the pinion inner 71 by the helical spline fitting, the thrust load in a direction approaching to the ring gear 23 is further generated.

Thereby, as shown in FIG. 6B, the pinion 74 meshes with the ring gear 23 at the predetermined meshing position. At this time, as shown in FIG. 6C, the pinion 74 is biased toward the ring gear 23 with respect to the pinion inner 71 by the pinion spring 11 (refer to FIG. 6A). Accordingly, the pinion 74 is maintained without relative movement with respect to the pinion inner 71 after meshing with the ring gear 23.

As the engine starts, and when the rotating speed of the pinion 74 exceeds the rotating speed of the output shaft 4, the one-way clutch function of the clutch mechanism 5 functions and the pinion 74 rotates idle. Further, power supply to the exciting coil 24 is stopped with a start of the engine, the pinion 74 is separated from the ring gear 23 by the biasing force of the return spring 21 to the clutch outer 18, the movable plate 8 is separated from the fixed contact plate 34, and then the DC brush motor 51 stops.

Advantageous Effects

According to the present embodiment, in a case that the rotating speed of the ring gear 23 is lower than that of the pinion 74, when the ring gear 23 meshes with the pinion 74 and the rotating force is transferred from the ring gear 23 to the pinion 74, the pinion 74 is capable of slides in a direction away from the ring gear 23 easily. That is, as the pinion 74 is lowered along the helical angle of the pinion inner-side helical external teeth 73 and the pinion-side helical internal teeth 74*a*, an impact force generated on the pinion 74 upon a contact of the end faces can be absorbed, and wears of parts upon meshing between the pinion 74 and the ring gear 23 can be suppressed. Thereby, a transfer of the load generated by the rotating force of the ring gear 23 to the starter 1 can be suppressed, and life spans can be prolonged by suppressing wears of parts such as clutch mechanism 5 and so on. Further, compared with a configuration in which an inner side external teeth of the pinion inner 71 meshes with an internal teeth of the pinion 74 by a straight spline meshing, the pinion 74 can be smoothly separated from the ring gear 23.

Further, the rotating force is applied on the pinion 74 slides in a direction away from the ring gear 23 by the rotation of the ring gear 23, the rotating speed of the pinion 74 is accelerated at each time this state is repeated, the rotating speed of the pinion 74 reached to that of the ring gear 23, and then the rotation of the pinion 74 and the rotation of the ring gear 23 synchronizes.

Then, once the ring gear 23 starts to mesh with the pinion 74 when the rotating speed of the pinion 74 becomes the same rotating speed of the ring gear 23 (synchronized state) or becomes higher than the rotating speed of the ring gear 23, a thrust load is generated on the pinion 74 in a direction approaching to the ring gear 23, and then the pinion 74 can be smoothly meshed with the ring gear 23.

Further, since the pinion spring 11 is provided between the pinion 74 and the pinion inner 71, the pinion 74 is capable of being pressed toward the ring gear 23 by the biasing force of the pinion spring 11 while suppressing an impact force generated upon a meshing between the pinion 74 and the ring gear 23 and while synchronizing the rotating speed of the pinion 74 with the rotating speed of the ring gear 23. Accordingly, it becomes possible to promptly mesh after the pinion 74 separates from the ring gear 23 while suppressing wear of parts upon meshing between the pinion and the ring gear.

Accordingly, it becomes possible to prolong the life span of the parts while maintaining a preferable linkage between a ring gear 23 and a pinion 74.

Further, embodiments of the present invention are not limited to the embodiment described above, and modification can be made to the above described embodiment without departing from a scope of the present invention.

In the above described embodiment, a configuration in which the pinion 74 and the ring gear 23 are mutually linked by the direct meshing. However, the present embodiment can be adopted to a configuration in which another gear, for example an idle gear, is interposed between the pinion 74 and the ring gear 23, and the pinion 74 is linked with the ring gear 23 via the idle gear.

In the above described embodiment is described based on an uniaxial starter 1 in which, the electromagnetic equipment 9 includes the exciting coil 24 and the plunger mechanism 37, and the exciting coil 24, the plunger mechanism 37 and the output shaft are coaxially disposed.

However, the embodiment of the present invention can be adopted not only for the uniaxial starter 1, but also for starters which include a configuration capable of advancing and retreating the plunger mechanism 37. For example, the embodiment of the present invention can be adopted to a various types of starters such as, a so-called biaxial type starter in which an electromagnetic equipment (plunger mechanism 37) and the output shaft 4 are disposed on the different axes, or so-called triaxial type starter in which an electromagnetic equipment (plunger mechanism 37), the rotating shaft 52 and the output shaft 4 are disposed on the different axes.

In the above described embodiment, the starter 1 which is used for starting of an automobile is described by an example, however, an application of the starter 1 is not limited to the automobile, but can be applied to, for example, an motorcycle.

Further, the starter 1 of the above described embodiment is provided with the damper mechanism on the pinion mechanism 70 and the pinion 74 can be stably meshed with the ring gear 23. Accordingly, applications of the starter 1 are not limited to an automobile which is equipped with an idling stop function, but can be applied to an automobile which is not equipped with an idling stop function.

According to the above, wears of parts upon meshing between a pinion and a ring gear can be suppressed. Further, a load generated by a rotating force of a ring gear can be suppressed from transferring to a starter. Thereby, life-spans of parts can be prolonged while maintain preferable linkage between the ring gear and the pinion.

REFERENCE SIGNS LIST

1 starter
3 motor
4 output shaft
9 electromagnetic equipment
11 pinion spring
23 ring gear
24 exciting coil
70 pinion mechanism
71 pinion inner
73 pinion inner-side helical external teeth
74 pinion
74A pinion-side helical external teeth
74*a* pinion-side helical internal teeth
80 gear plunger
F1, F3, F4, F5 thrust load

The invention claimed is:

1. A starter comprising: an output shaft configured to rotate by receiving a rotating force of a motor; a pinion mechanism slidably provided on the output shaft, the pinion mechanism configured to be linkable with a ring gear of the engine and configured to transfer the rotation of the output shaft to the ring gear; and an electromagnetic equipment configured to supply and cutoff power to the motor, the electromagnetic equipment configured to bias a pressing force on the pinion mechanism toward the ring gear, wherein the pinion mechanism comprises: a pinion inner provided on an outside of the output shaft and being slidable along the output shaft; a pinion provided concentrically with the pinion inner outward in a radial direction and capable of meshing with the ring gear; and a pinion spring disposed between the pinion and the pinion inner to bias the pinion toward the ring gear, wherein the pinion is formed with a pinion-side helical external teeth which has a twisting angle and is capable of meshing with the ring gear and a pinion-side helical internal teeth which has a twisting angle and is capable of meshing with the pinion inner, wherein the pinion inner is formed with a pinion inner-side helical external teeth which has a twisting angle and is capable of meshing with the pinion side helical internal teeth, wherein the pinion-side helical external teeth is configured such that, upon when the ring gear meshes with the pinion, a thrust load is generated on the pinion in a direction away from the ring gear when the rotating speed of the pinion is lower than that of the ring gear, and upon when the ring gear meshes with the pinion, the thrust load in a direction approaching to the ring gear is generated on the pinion when the rotating speed of the pinion is higher than that of the ring gear, wherein the pinion-side helical internal teeth and the pinion inner-side helical external teeth are configured such that, upon when the ring gear meshes with the pinion, a thrust load in a direction approaching to the ring gear is generated on the pinion when the rotating speed of the pinion is lower than that of the ring gear, and wherein, upon when the ring gear meshes with the pinion, the thrust load in a direction away from the ring gear is generated on the pinion when the rotating speed of the pinion is higher than that of the ring gear.

2. The starter according to claim 1, wherein
the twisting direction of the pinion inner-side helical external teeth is set in the same direction with the twisting direction of the pinion-side helical external teeth which meshes with the ring gear.

3. The starter according to claim 1 or 2, wherein
twisting directions of the pinion-side helical external teeth, pinion-side helical internal teeth and the pinion inner-side helical external teeth are defined based on a twisting direction of a teeth part of the ring gear.

4. The starter according to claims 1, or 2, or 3, wherein the electromagnetic equipment comprises: an exciting coil provided in a cylindrical shape; and a gear plunger capable of sliding moving along the output shaft based on a power supply to the exciting coil and configured to bias a pressing force on the pinion mechanism, wherein the electromagnetic equipment is provided coaxially with the output shaft.

* * * * *